US008186362B1

(12) United States Patent
Wilhelm

(10) Patent No.: US 8,186,362 B1
(45) Date of Patent: May 29, 2012

(54) CONCAVE FINGER NAIL FILE

(76) Inventor: John David Wilhelm, Stevenville, TX (US)

( * ) Notice: Subject to any disclaimer, the term of this patent is extended or adjusted under 35 U.S.C. 154(b) by 52 days.

(21) Appl. No.: 12/848,750

(22) Filed: Aug. 2, 2010

(51) Int. Cl.
*A45D 29/18* (2006.01)

(52) U.S. Cl. ..... 132/76.4

(58) Field of Classification Search ..... 132/73, 132/75.6, 76.5, 76.4; D28/59; 451/523–525
See application file for complete search history.

(56) References Cited

U.S. PATENT DOCUMENTS 6,488,574 B1 * 12/2002 Calafut ..... 451/523
2008/0223385 A1 * 9/2008 Cha ..... 132/76.4
2008/0264438 A1 10/2008 Clelland
2009/0159092 A1 * 6/2009 Munoz et al. ..... 132/76.4
2011/0139168 A1 * 6/2011 Burden et al. ..... 132/76.4
* cited by examiner

*Primary Examiner* — Rachel Steitz
(74) *Attorney, Agent, or Firm* — Donald J. Ersler

(57) ABSTRACT

A concave finger nail file includes a retention base and an abrasive surface. The retention base may have any suitable shape, such as a cube, a cylinder or a D-shaped tube. The retention base may be solid or hollowed-out. A concave cavity is formed in a top of the retention base. The abrasive surface is applied to the concave cavity. The abrasive surface may also be applied to a bottom or to a side wall of the retention base. The retention base is held between a forefinger and thumb of one hand; a finger or thumb of the other hand is inserted into the concave cavity; and the retention base is pivoted about the finger or thumb of the other hand to file the end of a nail. A second embodiment of the concave finger nail file includes a removable peel and stick abrasive surface.

15 Claims, 2 Drawing Sheets

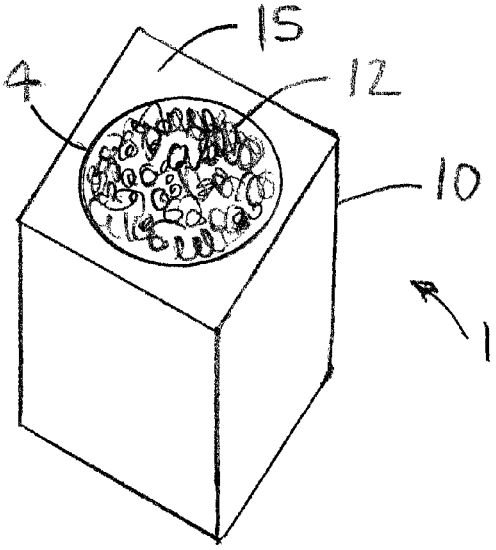
FIG. 1
FIG. 2
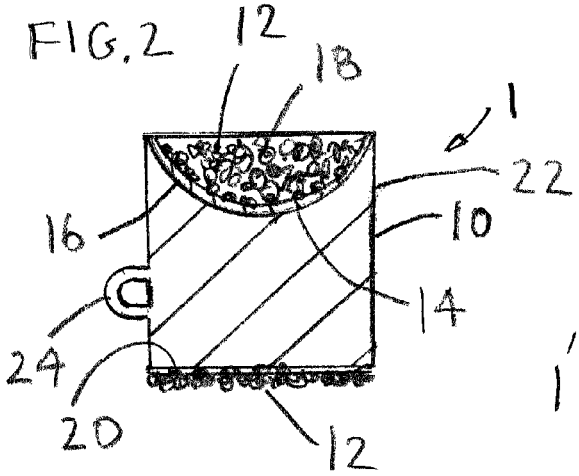
FIG. 4
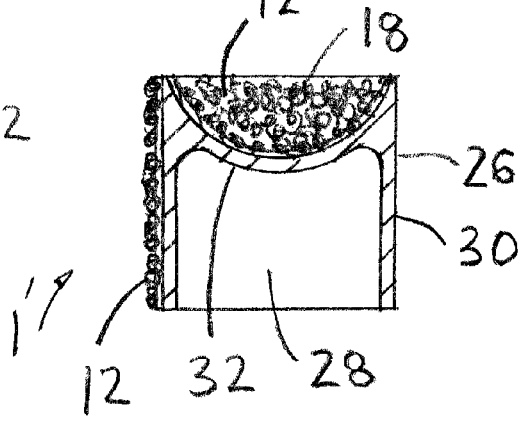
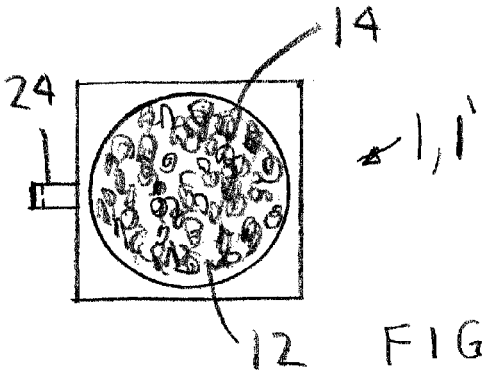
FIG. 3
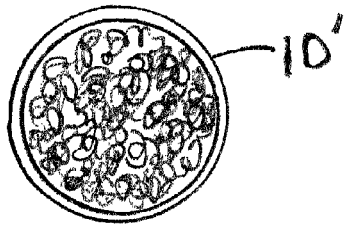
FIG. 5

CONCAVE FINGER NAIL FILE

BACKGROUND OF THE INVENTION

1. Field of the Invention

The present invention relates generally to finger nail files and more specifically to a concave finger nail file, which provides a finger filing device that may be comfortably stored in a pants pocket.

2. Discussion of the Prior Art

Patent application no. 20080264438 to Clelland discloses a curved ergonomic fingernail file in a compact design. The Clelland patent includes a finger grip having a ridged handle and a curved file base that decrease in thickness as it flares out toward its rounded tip.

Accordingly, there is a clearly felt need in the art for a concave finger nail file, which provides a finger filing device that may be comfortably stored in a pants pocket and retained on a key chain.

SUMMARY OF THE INVENTION

The present invention provides a concave finger nail file, which provides a finger filing device that may be stored comfortably in a pants pocket. The concave finger nail file includes a retention base and an abrasive surface. The retention base may have any suitable shape, such as a cube, a cylinder or a D-shaped tube. The retention base may be solid or hollowed-out. A concave cavity is formed in a top of the retention base. A width of the concave cavity is preferably slightly bigger than the width of a finger or thumb. The abrasive surface is formed on the concave cavity. The abrasive surface may also be applied to a bottom or to a side wall of the retention base. The retention base is held between a forefinger and thumb of one hand; a finger or thumb of the other hand is inserted into the concave cavity; and the retention base is pivoted about the finger or thumb of the other hand to file the end of a nail.

A second embodiment of a concave finger nail file includes a retention base and a peel and stick abrasive insert. The retention base may have any suitable shape, such as a cube, a cylinder or a D-shaped tube. The retention base may be solid or hollowed-out. The peel and stick abrasive insert preferably includes a concave cup, a plurality of grit particles and a peel-off label. The plurality of grit particles are applied to an inside surface of the concave cup with any suitable process. A pull out tab preferably extends from a perimeter of the concave cup. A pressure sensitive adhesive is applied to an outside surface of the concave cup. The peel-off label is then applied to the pressure sensitive adhesive. The peel and stick abrasive insert is secured to the concave cavity of the retention base by removing the peel-off label and pressing the concave cup into the concave cavity. When the plurality of grit particles are used up, the pull out tab is pulled to remove the peel and stick abrasive insert from the concave cavity.

Accordingly, it is an object of the present invention to provide a concave finger nail file, which provides a finger filing device that may be comfortably stored in a pants pocket and retained on a key chain.

These and additional objects, advantages, features and benefits of the present invention will become apparent from the following specification.

BRIEF DESCRIPTION OF THE DRAWINGS

FIG. 1 is a perspective view of a concave finger nail file in accordance with the present invention.

FIG. 2 is a cross sectional view of a concave finger nail file with a solid retention base in accordance with the present invention.

FIG. 3 is a top view of a concave finger nail file with a cube shaped retention base in accordance with the present invention.

FIG. 4 is a cross sectional view of a concave finger nail file with a hollowed-out retention base in accordance with the present invention.

FIG. 5 is a top view of a concave finger nail file with a cylindrical shaped retention base in accordance with the present invention.

DETAILED DESCRIPTION OF THE PREFERRED EMBODIMENTS

Figure 6:
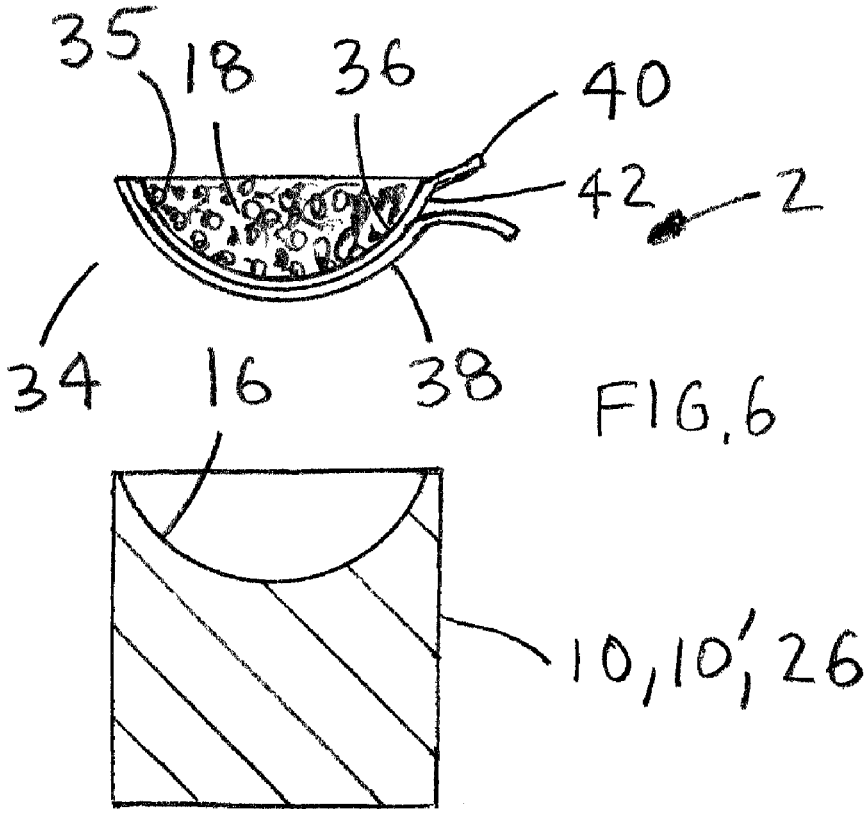
FIG. 6 is a partially exploded cross sectional view of a second embodiment of a concave finger nail file with a peel and stick abrasive insert in accordance with the present invention.

With reference now to the drawings, and particularly to FIG. 1, there is shown a perspective view of a concave finger nail file 1. With reference to FIGS. 2-3, the concave finger nail file 1 includes a retention base 10 and an abrasive surface 12. With reference to FIG. 5, the retention base 10, 10' may have any suitable shape, such as a cube, a cylinder or a D-shaped tube. A concave cavity 14 is formed in a top surface 15 of the retention base 10. A width of the concave cavity 14 is preferably slightly bigger than the width of a finger or thumb. The abrasive surface 12 preferably includes an adhesive 16 and a plurality of grit particles 18. The plurality of grit particles 18 are capable of abrading a human finger nail. The adhesive 16 or the like is applied to the concave cavity 14 and the plurality of grit particles 18 applied to the adhesive 16. However, other methods of creating the abrasive surface 12 may also be used. The abrasive surface 12 may also be applied to a bottom surface 20 or to a side surface 22 of the retention base 10. A loop 24 may be formed or attached to the bottom surface 20 or one of the side surfaces 22 for attachment to a key chain.

With reference to FIG. 4, a bottom portion of a concave finger nail file 1' includes a retention base 26. The concave cavity 14 is formed in a top surface of the retention base 26. The retention base 26 includes a hollowed-out cavity 28 formed in a bottom portion thereof. The hollowed-out cavity 28 creates at least one side wall 30 and a cavity wall 32. The hollowed-out cavity 28 enables the retention base 26 to be injection molded from a plastic material.

Figure 7:
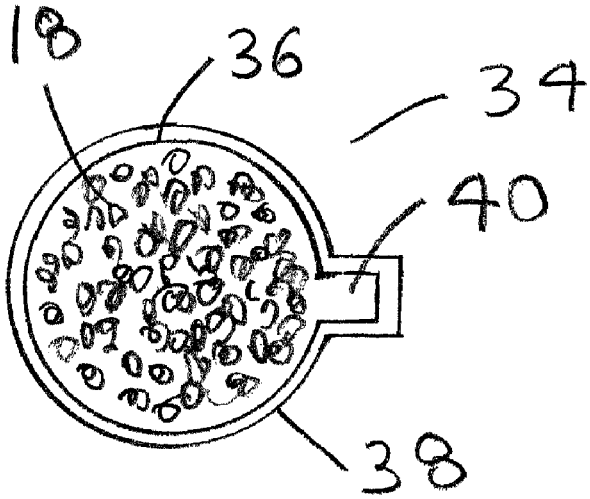
FIG. 7 is a top view of a peel and stick abrasive insert of a second embodiment of a concave finger nail file in accordance with the present invention.

With reference to FIGS. 6-7, a second embodiment of a concave finger nail file 2 includes the retention base 10, 10', 26 and a peel and stick abrasive insert 34. The peel and stick abrasive insert 34 preferably includes a concave cup 36, the plurality of grit particles 18 and a peel-off label 38. The concave cup 36 may be fabricated from a plastic material, cardboard or any other suitable material. An adhesive 35 or the like is applied to an inside surface of the concave cup 36 and the plurality of abrasive particles 18 are applied to the adhesive 35.

A pull out tab 40 preferably extends from a perimeter of the concave cup 36. A pressure sensitive adhesive 42 is applied to an outside surface of the concave cup 36. The peel-off label 38 is then applied to the pressure sensitive adhesive 42 to prevent premature sticking. The peel and stick abrasive insert 34 is secured to the concave cavity 16 of the retention base 10,10', 26 by removing the peel-off label 38 and pressing the concave cup 36 into the concave cavity 16. When the plurality of grit particles 18 are clogged-up, the pull out tab 40 is pulled to remove the peel and stick abrasive insert from the concave cavity 16.

The retention base 10, 10', 26 is held between a forefinger and thumb of one hand; a finger or thumb of the other hand is inserted into the concave cavity 14; and the retention base 10, 10', 26 is pivoted about an end of a finger nail of or an end of a thumb nail of the other hand to file the end of the finger or thumb nail.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A concave finger nail file comprising:

a retention base having a top surface and at least one side surface, a concave cavity is formed in said top surface;

an abrasive surface is formed in said concave cavity, said abrasive surface includes a plurality of grit particles for abrading an end of a human finger nail; and a hollowed-out cavity is formed in a bottom portion of said retention base to form at least one side wall and a cavity wall, a top portion of said hollowed-out cavity includes a convex shape, said hollowed-out cavity having a greater volume than said concave cavity.

2. The concave finger nail file of claim 1, further comprising:

an adhesive is applied to said concave cavity, said plurality of grit particles are applied to said adhesive.

3. The concave finger nail file of claim 1, further comprising:

a loop extends from an exterior surface of said retention base.

4. The concave finger nail file of claim 1, further comprising:

said concave cavity having a width that is greater than a width of a human finger or thumb.

5. The concave finger nail file of claim 1, further comprising:

a peel and stick abrasive insert is removably retained in said concave cavity, said peel and stick abrasive insert includes a concave cup, said plurality of grit particles, a pressure sensitive adhesive and a peel-off label, said plurality of grit particles are retained on an inner surface of said concave cup, said pressure sensitive adhesive is applied to an outer surface of said concave cup, said peel-off label is applied to said pressure sensitive adhesive.

6. The concave finger nail file of claim 1, further comprising:

a peel and stick abrasive insert is removably retained in said concave cavity, said peel and stick abrasive insert includes a concave cup, said plurality of grit particles, a pressure sensitive adhesive and a peel-off label, said plurality of grit particles are retained on an inner surface of said concave cup, said pressure sensitive adhesive is applied to an outer surface of said concave cup, said peel-off label is applied to said pressure sensitive adhesive.

7. A concave finger nail file comprising:

a retention base having a top surface and at least one side surface, a concave cavity is formed in said top surface;

a second abrasive surface is applied to at least one of said at least side surface;

an abrasive surface is formed in said concave cavity, said abrasive surface includes a plurality of grit particles for abrading an end of a human finger nail; and a hollowed-out cavity is formed in a bottom portion of said retention base to form at least one side wall and a cavity wall, a top portion of said hollowed-out cavity includes a convex shape, said hollowed-out cavity having a greater volume than said concave cavity.

8. The concave finger nail file of claim 7, further comprising:

an adhesive is applied to said concave cavity, said plurality of grit particles are applied to said adhesive.

9. The concave finger nail file of claim 7, further comprising:

a loop extends from an exterior surface of said retention base.

10. The concave finger nail file of claim 7, further comprising:

said concave cavity having a width that is greater than a width of a human finger or thumb.

11. The concave finger nail file of claim 7, further comprising:

a peel and stick abrasive insert is removably retained in said concave cavity, said peel and stick abrasive insert includes a concave cup, said plurality of grit particles, a pressure sensitive adhesive and a peel-off label, said plurality of grit particles are retained on an inner surface of said concave cup, said pressure sensitive adhesive is applied to an outer surface of said concave cup, said peel-off label is applied to said pressure sensitive adhesive.

12. A concave finger nail file comprising:

a retention base having a top surface and at least one side surface, a concave cavity is formed in said top surface;

an abrasive surface is formed in said concave cavity, said abrasive surface includes a plurality of grit particles for abrading an end of a human finger nail; and a hollowed-out cavity is formed in a bottom portion of said retention base to form at least one side wall, said hollowed-out cavity having a greater volume than said concave cavity.

13. The concave finger nail file of claim 12, further comprising:

an adhesive is applied to said concave cavity, said plurality of grit particles are applied to said adhesive.

14. The concave finger nail file of claim 12, further comprising:

a loop extends from an exterior surface of said retention base.

15. The concave finger nail file of claim 12, further comprising:

said concave cavity having a width that is greater than a width of a human finger or thumb.

* * * * *